US005460430A

United States Patent [19]

Miga, Jr. et al.

[11] Patent Number: 5,460,430

[45] **Date of Patent: * Oct. 24, 1995**

[54] SEAT FOR INFANT

[75] Inventors: Charles W. Miga, Jr., Warwick; Khipra Nichols, Rumford, both of R.I.

[73] Assignee: Hasbro, Inc., Pawtucket, R.I.

[ * ] Notice: The portion of the term of this patent subsequent to Dec. 13, 2013 has been disclaimed.

[21] Appl. No.: 166,512

[22] Filed: Dec. 13, 1993

Related U.S. Application Data

[63] Continuation of Ser. No. 903,166, Jun. 24, 1992, Pat. No. 5,269,591.

[51] Int. Cl.[6] ..... A47C 7/02

[52] U.S. Cl. ..... 297/452.13; 297/DIG. 11; 297/51

[58] Field of Search ..... 297/DIG. 11, 452.11, 297/452.13, 452.18, 16.1, 31, 51, 250.1, 354.12, 363, 364, 374, 376, 378.1, 378.12, 423.19, 423.26, 440.11, 440.15

[56] References Cited

U.S. PATENT DOCUMENTS

| | | | |
|---|---|---|---|
| 2,309,881 | 2/1943 | Wise | 297/DIG. 11 X |
| 2,672,916 | 3/1954 | Kenney . | |
| 2,740,465 | 4/1956 | Mulger . | |
| 2,848,040 | 8/1958 | Chernivsky . | |
| 3,004,793 | 10/1961 | Loomis . | |
| 3,017,220 | 1/1962 | Chernivsky . | |
| 3,066,906 | 12/1962 | Berlin . | |
| 3,110,519 | 11/1963 | Chernivsky . | |
| 3,235,306 | 2/1966 | Chernivsky . | |
| 3,695,685 | 10/1972 | Lamb . | |
| 4,081,869 | 4/1978 | Ash . | |
| 4,188,678 | 2/1980 | Rawolle . | |
| 4,371,206 | 2/1983 | Johnson, Jr. . | |
| 4,553,786 | 11/1985 | Lockett, III et al. . | |
| 4,836,573 | 6/1989 | Gebhard . | |
| 5,207,478 | 5/1993 | Freese et al. | 297/452.13 X |

FOREIGN PATENT DOCUMENTS

| | | |
|---|---|---|
| 3322344 | 10/1984 | Germany . |

*Primary Examiner*—Kenneth J. Dorner
*Assistant Examiner*—Milton Nelson, Jr.
*Attorney, Agent, or Firm*—Kurt R. Benson

[57] ABSTRACT

A seat for an infant includes a base frame portion which includes a pair of upwardly and rearwardly extending inclined members, a pair of connecting assemblies, a collapsible back frame portion, a leg frame portion, and a cover on the back and leg frame portions. The connecting assemblies are operative for connecting the back and leg frame portions to the inclined members so that the back frame portion normally extends upwardly and rearwardly therefrom, and so that the leg frame portion normally extends forwardly therefrom, but so that the leg and back frame portions are optionally pivotable rearwardly and downwardly to a collapsed position of the seat without requiring disassembly thereof.

3 Claims, 3 Drawing Sheets

SEAT FOR INFANT

This is a continuation of U.S. application Ser. No. 07/903,166 (now U.S. Pat. No. 5,269,591) filed on Jun. 24, 1992.

BACKGROUND AND SUMMARY OF THE INVENTION

The instant invention relates to furniture for infants, and more particularly to a seat for an infant of the general type commonly referred to as a "baby bouncer".

"Baby bouncer" seats have generally been found to be relatively effective for comfortably supporting and rocking infants in seating positions. In this regard, "baby bouncer" seats generally comprise a wire frame comprising a base frame including a chain portion which is adapted for receiving and supporting the seat on a supporting surface, and a pair of angular members which extend angularly upwardly and rearwardly from the front end of the main portion. "Baby bouncer" seats of this type generally further comprise leg and back frame portions which are supported on the angular frame members thereof, and a fabric covering which extends over the leg and back frame members for supporting an infant thereon. The angular members of the base frames of seats of this type are normally resiliently deflectable downwardly slightly toward the main portions of the base frames thereof. Accordingly, when an infant is supported on the fabric covering on the leg and back frame members of a seat of this type the infant can be gently rocked in the seat by moving the back and leg frame members up and down slightly so that the angular members are slightly resiliently bent downwardly, and then resiliently moved upwardly to gently rock the infant in the seat. "Baby bouncer" seats of this general type representing the closest prior art to the subject invention of which the applicant is aware are disclosed in the U.S. Patents to Chernivsky U.S. Pat. No. 2,848,040; Chernivsky U.S. Pat. No. 3,017,220; Chernivsky U.S. Pat. No. 3,110,519; and Lockett III et al U.S. Pat. No. 4,553,786.

While the previously available "baby bouncer" seats have generally been found to be effective and desirable from the standpoint of providing effective seats which are operative for gently rocking infants, they have generally not been readily collapsible without disassembling the components thereof, and hence, it has not been practical to transport or store many of these previously available devices. As a result, it has been found that there is a recognized need for an effective "baby bouncer" seat which is readily and easily movable between collapsed and assembled positions so that it can be more easily transported and stored.

The instant invention provides an effective seat of the above-described general type, which is adapted to be quickly and easily moved between fully collapsed and fully assembled positions. Specifically, the instant invention provides an infant seat comprising a base frame portion including a main portion which is receivable on a supporting surface and a pair of angular members which extend angularly upwardly and rearwardly in spaced substantially parallel relation from the main portion of the base frame portion. The seat further comprises a back frame portion including a pair of spaced back frame side members, a leg frame portion including a pair of spaced leg frame side members, and a pair of connector assemblies for permanently connecting the back frameside members to the angular members so that the back frame side members are securable in an operative position wherein the back frame side members extend upwardly and rearwardly from the angular members, but so that the back frame side members are optionally pivotable toward the main portion of the base frame portion. The connector assemblies are further operative for permanently connecting the leg frame side members to the angular members, so that the leg frame portion extends forwardly therefrom, but preferably so that the leg frame portion is pivotable rearwardly toward the back frame portion. Accordingly, the back frame portion is readily and easily securable in an operative position wherein it extends angularly upwardly and rearwardly from the angular members, but it is alternatively pivotable rearwardly to a collapsed position, wherein it remains connected to the connector assemblies, but wherein it is pivoted toward the main portion of the base frame portion. Further, the leg frame portion is readily and easily positionable in an operative position, wherein it extends forwardly from the connector assemblies, but it is alternatively pivotable rearwardly toward the back frame portion to a collapsed position, wherein it also remains connected to the connector assemblies, but wherein it is positioned alongside the back frame portion when the back frame portion is pivoted toward the main portion of the base frame portion.

The back frame portion is preferably also formed in a collapsible construction. Accordingly, the back frame portion preferably includes upper and lower portions and a pair of pivot assemblies connecting the upper and lower portions of the back frame portion, so that the upper portions are positionable in operative positions, wherein they extend rearwardly in substantially aligned relation from the respective lower portions thereof, but so that they are optionally pivotable forwardly and downwardly toward the lower portion to position the back frame portion in a fully collapsed position.

The connector assemblies for connecting the back and leg frame side members to the angular members preferably comprise inner and outer housing sections which are rotatable relative to one another. Each of the inner housing sections is permanently attached to one of either the adjacent back frame section or the adjacent angular member, and each of the outer housing sections is permanently attached to the other of either the adjacent back frame member, or the adjacent angular member. The outer housing sections preferably have side walls having apertures therein, and each of the connector assemblies preferably further comprises a spring-loaded button attached to the inner housing section thereof and releasably receivable in the aperture in the side wall of the outer housing section thereof for securing the relative positions of the inner and outer housing sections in order to secure the back frame portion in the operative position.

It has been found that the instant invention provides an effective seat for infants which has specific advantages over the heretofore available "baby bouncer" seats. Specifically, it has been found that the connector assemblies of the seat of the instant invention are operative for effectively permanently attaching the back frame portion to the base frame portion, so that the back frame portion is readily securable in an operative position but nevertheless readily pivotable to a collapsed position, wherein the back frame portion is positioned adjacent the main portion of the base frame portion. It has been further found that the connector assemblies are effectively operative for permanently securing the leg frame portion to the base frame portion in a manner which also permits the leg frame portion to be pivoted to a collapsed position adjacent the back frame portion. Still further, it has been found that the pivot assemblies in the back frame portion also enable the back frame portion to be moved to an even further collapsed position, wherein the upper portion of the back frame portion is pivoted toward the lower portion of the back frame portion, so that the entire seat can be moved to a fully collapsed position wherein it is readily transportable.

Accordingly, it is a primary object of the instant invention to provide a "baby bouncer" type seat which is readily and easily collapsible.

Another object of the instant invention is to provide a "baby bouncer" seat which is collapsible without requiring disassembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
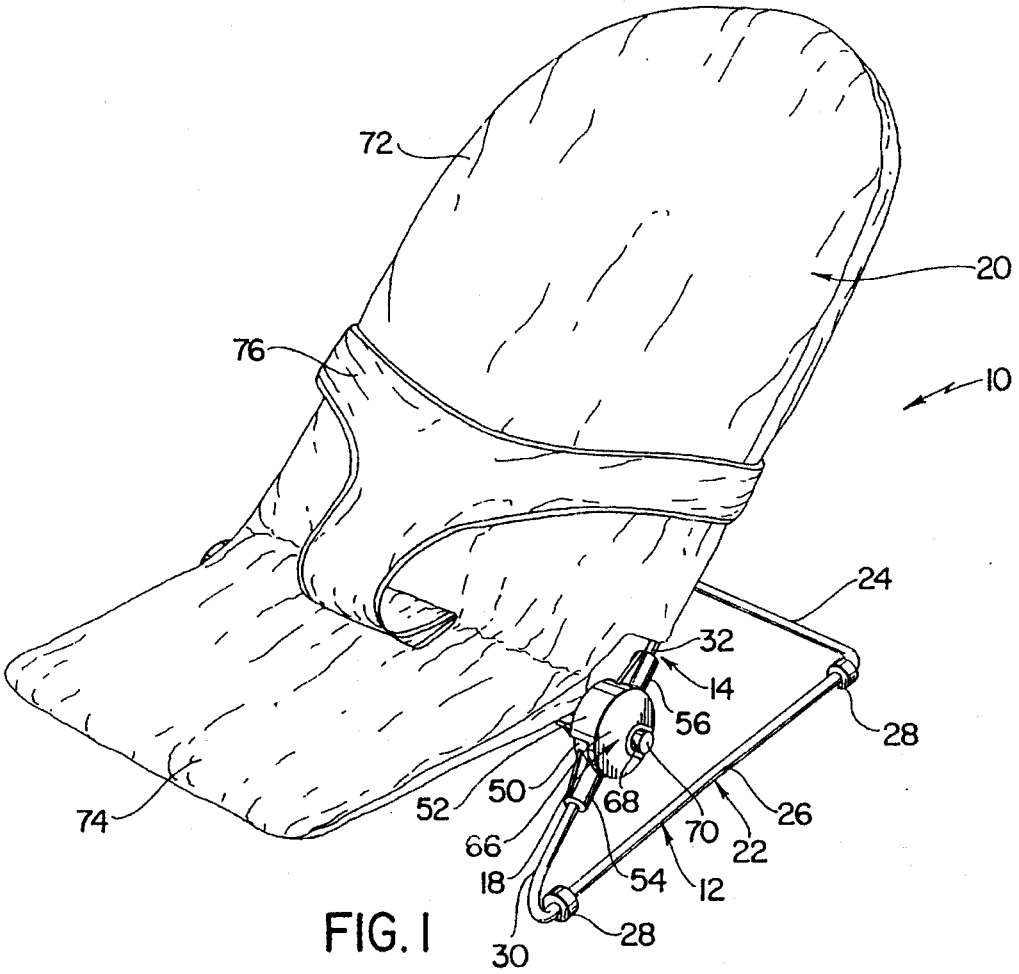
FIG. 1 is a perspective view of the infant's seat of the instant invention.
Figure 4:
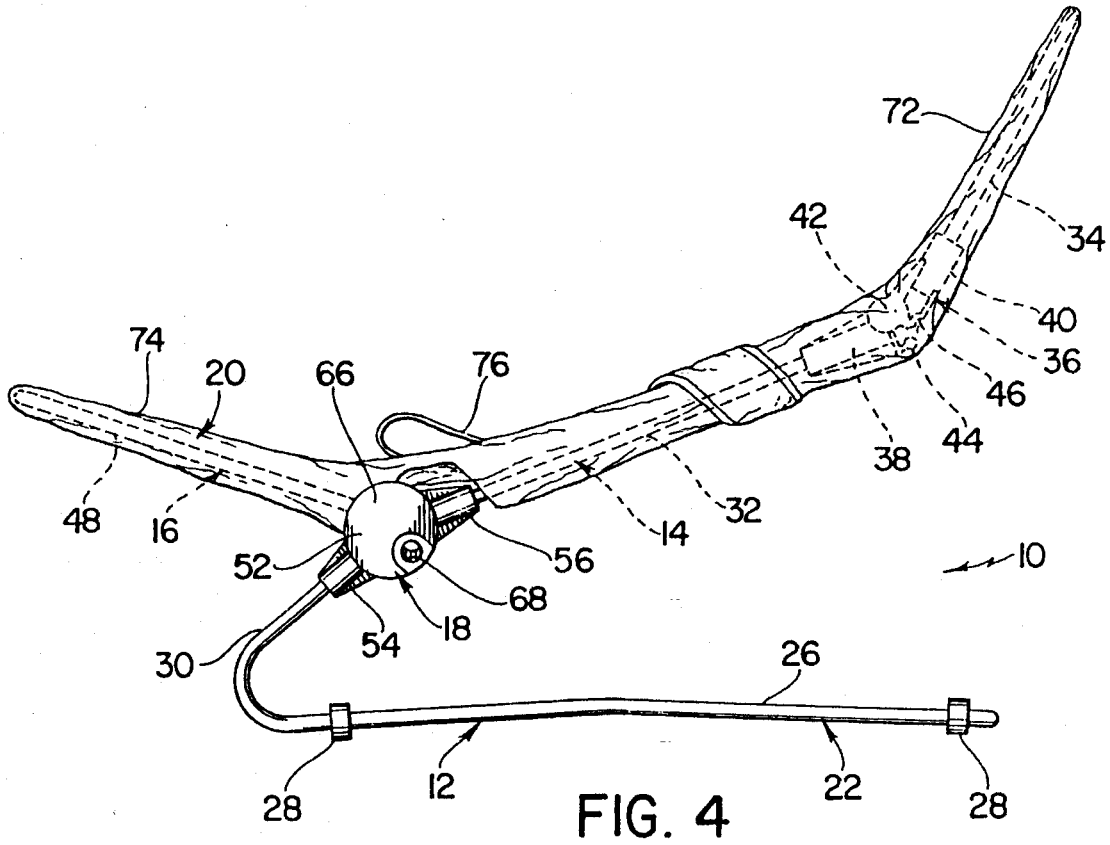
FIG. 4 is a side elevational view of the seat with the back frame portion in a partially collapsed position.
Figure 5:
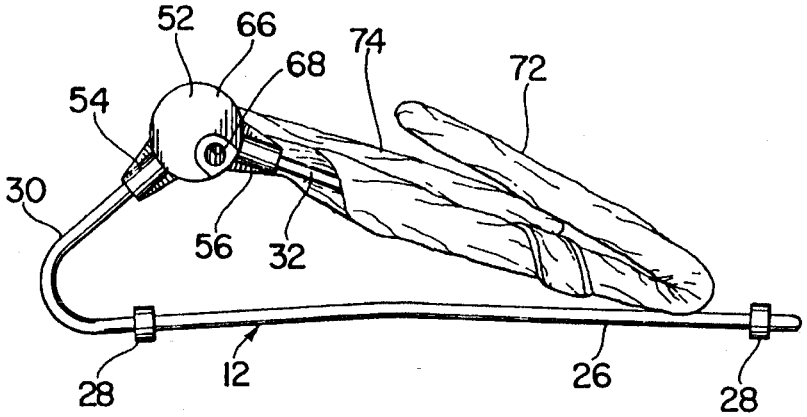
FIG. 5 is a side elevational view of the seat in a fully collapsed position.
Figure 6:
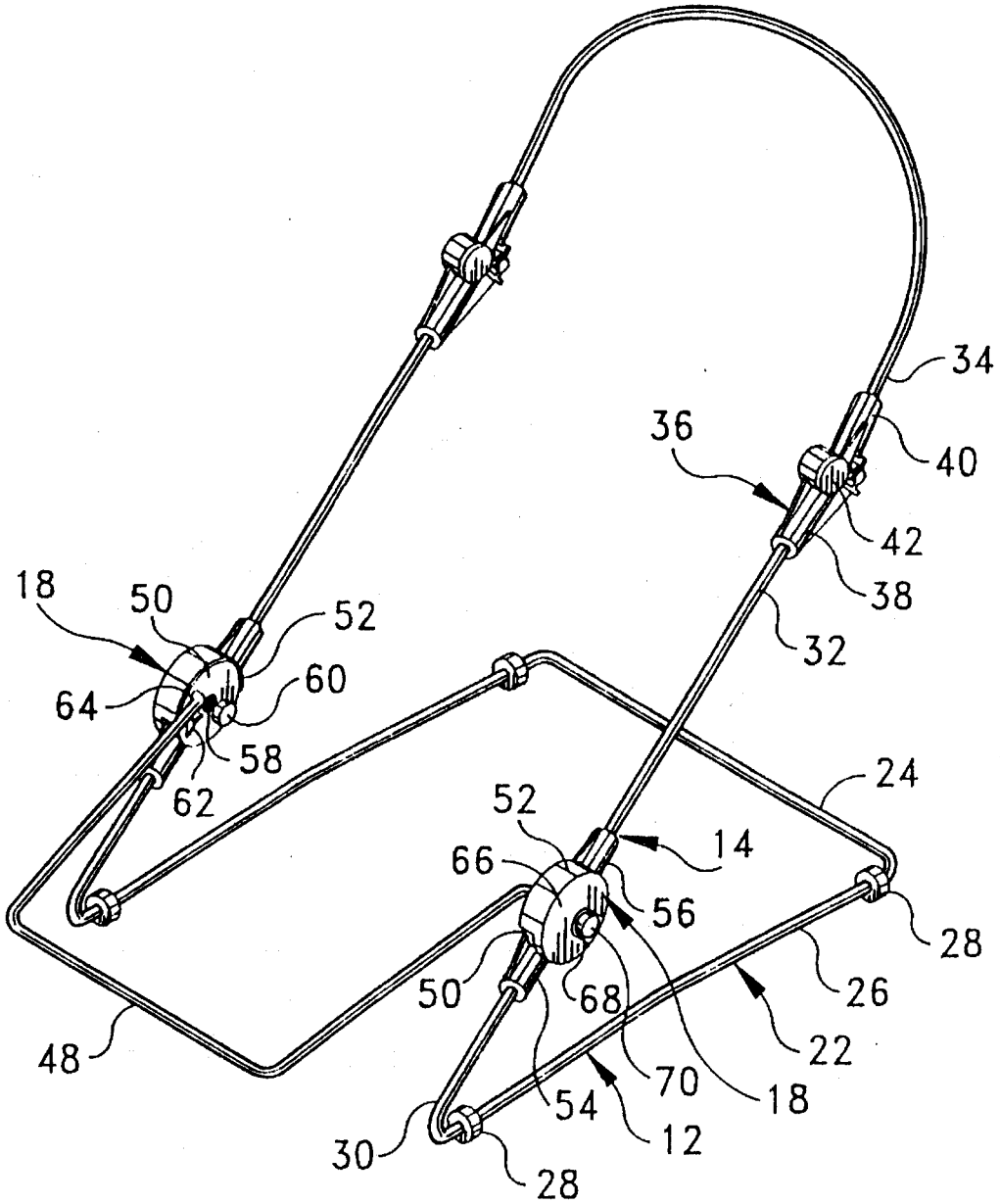
FIG. 6 is a perspective view of the frame portions of the seat in an erected position.

Referring now to the drawings, the infant's seat of the instant invention is illustrated and generally indicated at 10 in FIGS. 1, 4, and 5. The seat 10 comprises a base frame portion generally indicated at 12, a back frame portion generally indicated at 14, a leg frame portion generally indicated at 16, a pair of connector assemblies generally indicated at 18, and a fabric cover 20. The base frame portion 12 is adapted to be received on a supporting surface for supporting the seat 10 thereon, and the back and leg frame portions 14 and 16, respectively, are permanently attached to the base frame portion 12 with the connector assemblies 18. The fabric cover 20 is received on the back and leg frame portions 14 and 16, respectively, for supporting an infant thereon, as illustrated most clearly in FIG. 1. The connector assemblies 18 and the back frame portion 14 are adapted to permit the seat 10 to be readily and easily moved between the fully assembled position illustrated in FIG. 1, and the collapsed position illustrated in FIG. 5, as will hereinafter be more fully set forth.

The base frame portion 12 comprises a main portion generally indicated at 22 which includes a transversely extending rear member 24, a pair of side members which extend forwardly from the rear member 24, and a pair of elastomeric rings 28 on each of the side members 26 which function as rubber feet for the base frame portion 12. The base frame portion 12 further comprises a pair of upwardly and rearwardly inclined members 30 which extend integrally from the forward ends of the side members 26. The rear member 24, the side members 26, and the inclined members 30 are preferably all integrally formed from a suitable resilient metal, such as steel, and the inclined members 30 are formed so that they are resiliently deflectable downwardly toward the side members 26, as will hereinafter be more fully set forth.

The back frame portion 14 comprises a pair of substantially straight lower side portions 32, and a U-shaped upper portion 34 which are preferably also made from a suitable metal, and a pair of pivot assemblies generally indicated at 36. Each of the pivot assemblies 36 comprises a lower pivot portion 38 which is permanently received on the end of the adjacent lower side portion 32 and an upper portion 40 which is permanently received on the adjacent lower end of the upper portion 34. The lower and upper pivot portions 38 and 40, respectively, of each of the pivot assemblies 36 are pivotally connected for pivoting about an axis 42 so that the upper back frame portion 34 is forwardly and downwardly pivotable relative to the lower side portions 32. Each of the lower pivot portions 38 of the pivot assemblies 36 includes an integrally formed locking piece 44 which is resiliently snap-receivable in a recess 46 in the respective upper pivot portion 40 thereof. The pivot assemblies 36 are adapted so that when the locking pieces 44 are received in the recesses 46 thereof the lower and upper pivot portions 38 and 40, respectively, and the lower side and upper frame portions 32 and 34, respectively, are in substantially aligned relation, but so that the U-shaped upper portion 34 is forwardly and downwardly pivotable to the fully collapsed position illustrated in FIG. 5.

The leg frame portion 16 includes a pair of side portions 48 having outwardly turned ends (not shown) thereon, and an end portion (not shown) which extends between the side portions 48. The leg frame portion 16 is preferably made from a suitable metal, such as steel, and the outwardly turned ends (not shown) thereof are rotatably received in the connector assemblies 18, as will hereinafter be more fully set forth.

Figure 2:
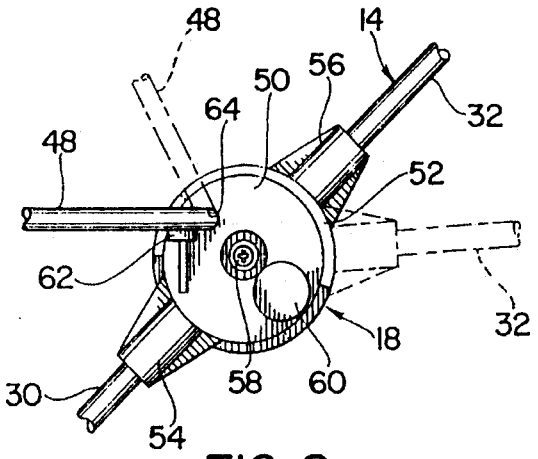
FIG. 2 is a side elevational view of the inner side of one of the connector assemblies.
Figure 3:
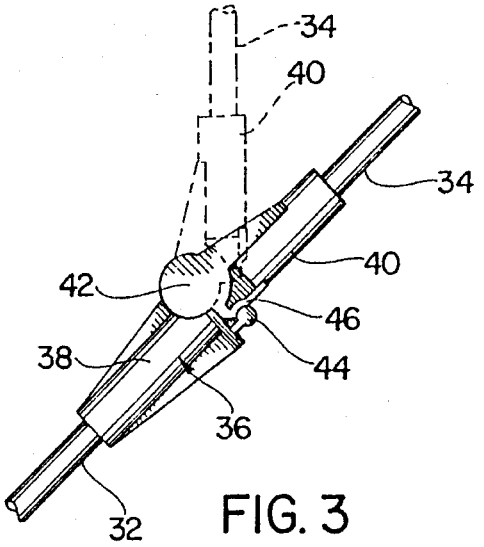
FIG. 3 is a side elevational view of one of the pivot assemblies.

The connector assemblies 18 each comprise a circular inner housing section 50 and a circular outer housing section 52. Each of the inner housing sections 50 has a connector portion 54 thereon which is adapted for receiving and permanently securing the terminal end portion of one of the inclined members 30 therein, and each of the outer housing sections 52 includes a connector portion 56 which is adapted for receiving and permanently securing the terminal end portion of one of the lower portions 32 of the back frame portion 14 therein. As illustrated most clearly in FIG. 2, the inner and outer housing sections 50 and 52, respectively of each of the connector assemblies 18, are rotatably connected about an axis 58. Further, each of the inner housing sections 50 includes an enlarged close-ended socket 60 and an integrally formed stop element 62. As will be further seen from FIG. 2, each of the inner housing portions 50 includes an aperture 64 adjacent the stop element 62 thereon for permanently, but rotatably receiving the inwardly turned end of the adjacent side portion 48 of the leg frame portion 16. The stop elements 62 are positioned so that they are operative for supporting the leg frame portion 16 in an operative position wherein it extends forwardly from the connector assemblies 18 as illustrated most clearly in FIG. 1. However, the leg frame portion 16 is nevertheless pivotable upwardly and rearwardly toward the back frame portion 14 in order to position the leg frame portion 16 in the collapsed position illustrated in FIG. 5. As illustrated most clearly in FIG. 1, each of the outer housing sections 52 includes an outer side wall 66 having a circular aperture 68 therein. Further, each of the connector assemblies 18 comprises a spring-loaded button 70 which is received in the socket 60 of the inner housing section 50 thereof so that the button 70 is receivable in the aperture 68 in the outer housing section 52 thereof. As further illustrated in FIG. 1, the buttons 70 and the apertures 68 of the connector assemblies 18 are oriented so that when the buttons 70 are received in their respective apertures 68 they are operative for securing the back frame portion 14 so that it extends upwardly in substantially aligned relation from the inclined members 30. However, by pressing the buttons 70 inwardly so that they are no longer received in the respective apertures 68 thereof, the inner and outer housing sections 50 and 52 of the connector assemblies 18 are rotatable relative to each other in order to pivot the back frame portion 14 rearwardly and downwardly to the collapsed position illustrated in FIG. 5.

The fabric cover 20 is preferably made from a suitable durable fabric: material and it includes a back portion 72 which is received on the back frame portion 14, and a leg portion 74 which is received on the leg frame portion 16 and integrally connected to the back portion 72. The cover 20 further comprises a strap portion 74 which is adapted to extend around the waist and between the legs of an infant in order to retain the infant in a seating position on the cover 20. The strap portion 76 is permanently attached to the back and leg portions 72 and 74. However, the entire cover portion 20 is adapted to be easily removed from the back and leg frame portions 14 and 16, respectively, so that it can be easily laundered.

For use and operation of the seat 10 the back frame portion 14 is moved to the position illustrated in FIG. 1, so that the buttons 70 are moved outwardly into the apertures 68 in order to lock the connector assemblies 18 in the operative positions thereof illustrated in FIG. 1. The leg frame portion 16 is then pivoted downwardly and forwardly so that the side portions 48 engage the stops 62. An infant can then be seated in the seat 10 so that the infant is retained on the cover 20 by the strap portion 76. Once seated, the infant can be gently rocked in the seat 10 by moving the back frame portion 14 up-and-down slightly so that the inclined portions 30 are resiliently bent rearwardly and downwardly slightly and then resiliently returned to their original positions. The infant can be gently rocked in this manner for an extended period of time, and in some instances the infant can also cause rocking movement to occur by moving back-and-forth in the chair 10.

It is seen therefore that the instant invention provides an effective "baby bouncer" seat for an infant. The seat 10 can be effectively utilized for supporting and rocking an infant while the infant is maintained in a seated position. However, once the infant is removed from the seat 10, the seat 10 can be effectively collapsed without disassembly for transportation or storage. Specifically, the upper portion 34 of the back frame portion 14 can be collapsed downwardly and forwardly as a result of the pivot assemblies 36, and the leg frame portion 16 can be pivoted rearwardly toward the back frame portion 14. Still further, the back frame portion 14 can be pivoted downwardly and rearwardly by pressing the buttons 70 inwardly to release the connector assemblies 18 so that the seat can be moved to the fully collapsed position thereof illustrated in FIG. 5. Hence, it is seen that the instant invention provides an effective "baby bouncer" type seat which is readily collapsible for transportation and storage without disassembly, and which therefore represents a significant improvement over the previously available seats of this general type.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A seat for an infant comprising a base frame portion including a main portion receivable on a supporting surface for supporting said seat thereon, said main portion including a pair of spaced base frame side members having front ends, said base frame portion further including a pair of inclined members extending angularly upwardly and rearwardly in spaced substantially parallel relation from the front ends of said base frame side members, a back frame portion including a pair of spaced back frame side members, a leg frame portion including a pair of spaced leg frame side members, connector means connecting said back frame side members to said inclined members so that said back frame side members extend upwardly and rearwardly from said inclined members and so that said back frame portion is supported by said inclined members, said connector means further being operative for connecting said leg frame side members to said inclined members so that said leg frame portion is positionable in an operative position wherein said leg frame portion extends forwardly from said connector means, but so that said leg frame portion is optionally freely pivotable toward said back frame portion to a collapsed position in which said leg frame portion is laid substantially flat against said back frame portion, said leg frame portion being supported by said inclined members when said leg frame portion is in the operative position thereof, and coveting means covering said back and leg frame portions for supporting said infant thereon.

2. A seat for an infant comprising a base frame portion including a main portion receivable on a supporting surface for supporting said seat thereon, said main portion including a pair of spaced base frame side members having front ends, said base frame portion further including a pair of inclined members extending angularly upwardly and rearwardly in spaced substantially parallel relation from the front ends of said base frame side members, a back frame portion including a pair of spaced back frame side members, a leg frame portion including a pair of spaced leg frame side members, connector means connecting said back frame side members to said inclined members so that said back frame side members extend upwardly and rearwardly from said inclined members and so that said back frame portion is supported solely through a supporting path which includes said inclined members, said connector means further being operative for connecting said leg frame side members to said inclined members so that said leg frame portion is positionable in an operative position wherein said leg frame portion extends forwardly from said connector means, but so that said leg frame portion is optionally freely pivotable toward said back frame portion, said leg frame portion being supported solely through a supporting path which includes said inclined members when said leg frame portion is in the operative position thereof, and covering means covering said back and leg frame portions for supporting said infant thereon.

3. A seat for an infant comprising:

a) a seat portion including i. a back frame portion including a pair of spaced back frame side members, ii. a leg frame portion including a pair of spaced leg frame side members, and iii. covering means extending between said back frame side members and said leg frame side members; and b) collapsible support means receivable on a supporting surface and operable in an erected position for supporting said seat portion thereon, said collapsible support means including a pair of opposite side connector elements connecting said back frame side members and said leg frame side members to said collapsible support means in order to support said seat portion on said collapsible support means, a pair of opposite base frame side members receivable on a supporting surface for supporting said collapsible support means thereon and a pair of inclined members extending between said opposite base frame side members and the respective opposite side connector elements thereof for supporting said opposite side connector elements and said seat portion on said base frame side members, said collapsible support means being moveable to a collapsed position by pivoting said base frame side members relative to said back frame side members at said connector elements for moving said base frame side members toward said back frame portion.

* * * * *